US007755560B2

(12) United States Patent
Park et al.

(10) Patent No.: US 7,755,560 B2
(45) Date of Patent: Jul. 13, 2010

(54) ANTENNA HAVING PARASITIC ELEMENT

(75) Inventors: Se-hyun Park, Gyeonggi-do (KR); Byung-tae Yoon, Gyeonggi-do (KR); Young-min Moon, Seoul (KR); Dong-jin Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 8 days.

(21) Appl. No.: 12/099,739

(22) Filed: Apr. 8, 2008

(65) Prior Publication Data

US 2009/0066603 A1 Mar. 12, 2009

(30) Foreign Application Priority Data

Sep. 7, 2007 (KR) ..... 10-2007-0090820

(51) Int. Cl.
*H01Q 19/10* (2006.01)

(52) U.S. Cl. ..... 343/834; 343/817; 343/833

(58) Field of Classification Search ..... 343/816, 343/817, 833, 834
See application file for complete search history.

(56) References Cited

U.S. PATENT DOCUMENTS

| | | | | |
|---|---|---|---|---|
| 5,294,939 | A * | 3/1994 | Sanford et al. | 343/836 |
| 5,420,599 | A * | 5/1995 | Erkocevic | 343/828 |
| 6,476,773 | B2 * | 11/2002 | Palmer et al. | 343/795 |
| 6,876,331 | B2 * | 4/2005 | Chiang et al. | 343/702 |
| 2006/0044205 | A1 * | 3/2006 | Lynch et al. | 343/833 |

* cited by examiner

*Primary Examiner*—Tho G Phan
(74) *Attorney, Agent, or Firm*—NSIP Law

(57) ABSTRACT

An antenna having a parasitic element is disclosed, the antenna including a ground, a radiation unit which is arranged on a different area of the same plane as the ground, and a parasitic element which is selectively connected to the ground, and operates as an antenna element. Where the antenna is in a first mode, electromagnetic waves resonate in the radiation unit, and where the antenna is in a second mode, electromagnetic waves resonate in the radiation unit and the parasitic element.

10 Claims, 9 Drawing Sheets

ANTENNA HAVING PARASITIC ELEMENT

CROSS-REFERENCE TO RELATED APPLICATIONS

This application claims the benefit under 35 U.S.C. §119 (a) of a Korean Patent Application No. 10-2007-0090820, filed on Sep. 7, 2007, in the Korean Intellectual Property Office, the disclosure of which is incorporated herein by reference in its entirety.

TECHNICAL FIELD

The following description relates to an antenna, and more particularly, to an antenna having a parasitic element.

BACKGROUND

Generally, the functions of a modern portable computer are no less varied than the functions of a desktop computer. A modern mobile computer is designed to be lightweight and to have various functions. For example, laptop computers, palmtop computers, personal digital assistants (PDA), and tablet personal computers all execute compute-intensive applications.

A peripheral component interconnect (PCI) interface adapter card may be replaced or inserted in a desktop computer. However, a portable computer may have restrictions with respect to space, weight, and power consumption. Accordingly, the number of extension slots which may be used in a portable computer may be limited.

A portable computer may be able to wirelessly communicate with a plurality of external apparatuses using a wireless local area network (LAN) card to compensate for such lack of extensibility.

Types of wireless LANs include, for example, Personal Computer Memory Card International Association (PCMCIA) cards, universal serial bus (USB) cards, and peripheral component interconnect (PCI) cards. A PCMCIA wireless LAN card may be provided for a notebook, wherein it is inserted in a PCMCIA card slot. A USB wireless LAN card may be connected to a USB port of a notebook computer or desktop computer, and a PCI wireless LAN card may be housed in a PCI card slot of a desktop computer.

Typically, the wireless LAN card requires an antenna for wireless communication. The antenna is smaller than the wireless LAN card or a ground provided in a portable computer. Beams emitted from an antenna are radiated toward a ground. Electromagnetic waves leak from the ground, and the average gain of the antenna drops, so antenna efficiency is diminished. If the antenna receives a large amount of power, the beams distributed toward the ground may not disrupt data communication. However, if the antenna receives a small amount of power, it is difficult for a portable computer to efficiently communicate with an external apparatus.

SUMMARY

According to one aspect, there is provided an antenna having a parasitic element which operates in a monopole mode or a dipole mode according to the conditions of the power supply which is transmitted or received.

According to another aspect, there is provided an antenna having a parasitic element, comprising a ground, a radiation unit which is disposed on a different area of the same plane as the ground, and a parasitic element which is selectively connected to the ground, and operates as an antenna element, wherein where the antenna is in a first mode, electromagnetic waves resonate in the radiation unit, and where the antenna is in a second mode, electromagnetic waves resonate in the radiation unit and the parasitic element.

The antenna may further comprise a feeding unit which feeds the radiation unit, wherein the feeding unit feeds the radiation unit in the first mode and the second mode, and the ground feeds the parasitic element in the second mode.

Where the antenna is in the first mode, the parasitic element may not be connected to the ground, and where the antenna is in the second mode, the parasitic element may be connected to the ground.

A frequency band of the electromagnetic wave resonating in the first mode may be the same as a frequency band of the electromagnetic wave resonating in the second mode.

The radiation unit and the parasitic element may be formed in a strip line configuration, and the radiation unit and the parasitic element of the second mode may be inclined at a predetermined angle.

The radiation unit of the second mode may be perpendicular to the parasitic element.

The radiation unit and the parasitic element of the second mode may be arranged on the same surface.

The radiation unit and the parasitic element may be disposed apart from each other at a predetermined distance, and arranged parallel to each other.

Other features will become apparent to those skilled in the art from the following detailed description, which, taken in conjunction with the attached drawings, discloses exemplary embodiments of the invention.

BRIEF DESCRIPTION OF THE DRAWINGS

Throughout the drawings and the detailed description, the same drawing reference numerals will be understood to refer to the same elements, features, and structures.

DETAILED DESCRIPTION

The following detailed description is provided to assist the reader in gaining a comprehensive understanding of the methods, apparatuses and/or systems described herein. Accordingly, various changes, modifications, and equivalents of the systems, apparatuses and/or methods described herein will be suggested to those of ordinary skill in the art. Also, descriptions of well-known functions and constructions are omitted to increase clarity and conciseness.

Figure 1:
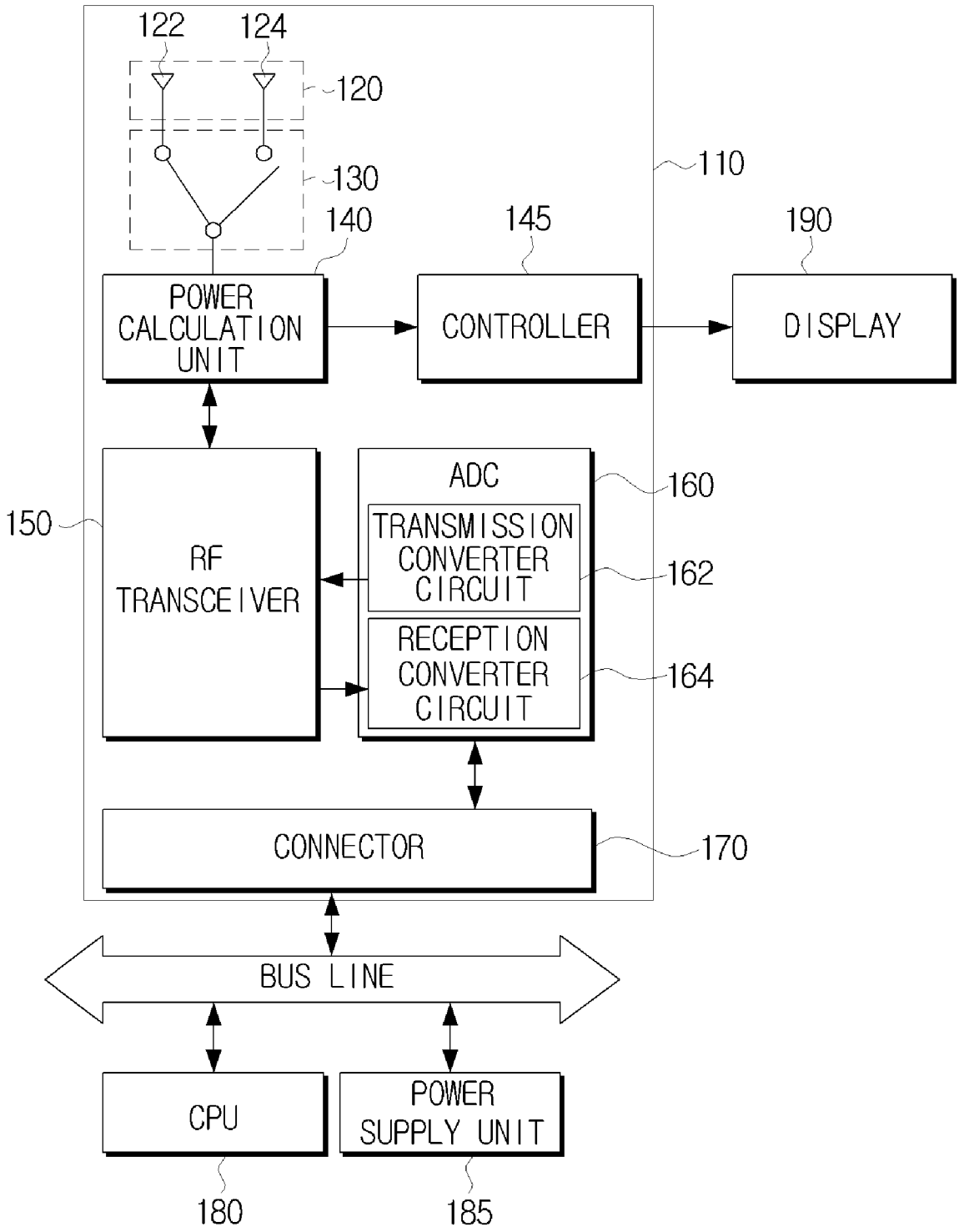
FIG. 1 is a block diagram illustrating a portable computer having a wireless communication unit according to an exemplary embodiment.

FIG. 1 is a block diagram illustrating a portable computer having a wireless communication unit 110 according to an exemplary embodiment. Referring to FIG. 1, a portable computer may comprise a detachable wireless communication unit 110, a central process unit (CPU) 180, a power supply unit 185, and a display 190. The wireless communication unit 110 may comprise a radiation unit 122, a parasitic element 124, a mode converter 130, a power calculation unit 140, a controller 145, a radio frequency (RF) transceiver 150, an analog to digital converter (ADC) 160, and a connector 170.

The length of the radiation unit 122 and the length of the parasitic element 124 may be a quarter of the resonance wavelength of an electromagnetic wave. The radiation unit 122 and the parasitic element 124 may be arranged in a strip line configuration. According to an aspect, the radiation unit 122 is firmly connected to the wireless communication unit 110, while the parasitic element 124 is detachably connected to the wireless communication unit 110. Where the parasitic element 124 is not connected to the wireless communication unit 110, the parasitic element 124 may not operate as an antenna element, and where the parasitic element 124 is connected to the wireless communication unit 110, the parasitic element 124 may operate as an antenna element.

Specifically, if the parasitic element 124 is not connected to the wireless communication unit 110, only the radiation unit 122 operates as an antenna element, so the antenna of the wireless communication unit 110 operates in a monopole mode. However, if the parasitic element 124 is connected to the wireless communication unit 110, not only the radiation unit 122 but also the parasitic element 124 operate as antenna elements, so the antenna of the wireless communication unit 110 operates in a dipole mode.

The wireless communication unit 110 according to an exemplary embodiment may be in a monopole mode or a dipole mode. In the monopole mode, the radiation unit 122 operates as an antenna element 120 to transmit and receive data. In the dipole mode, both the radiation unit 122 and the parasitic element 124 operate as antenna elements 120 to transmit and receive data. The wireless communication units 110 of the monopole mode and dipole mode transmit and receive data within the same frequency band. Where the transmitted and received data have low power, the wireless communication unit 110 may transmit and receive data in the dipole mode. Where the data are transmitted and received in the dipole mode, a beam pattern radiated from the radiation unit 122 may be formed in an opposite direction to the ground of the wireless communication unit 110. Therefore, the average gain of the dipole antenna is reduced less than that of the monopole mode antenna.

The mode converter 130 switches the wireless communication unit 110 between the monopole mode and the dipole mode.

The power calculation unit 140 computes the amount of power transmitted to and received from the antenna elements 120, and transmits the computed result to the controller 145. The power calculation unit 140 transmits to the RF transceiver 150 the data transmitted to and received from the antenna elements 120.

The RF transceiver 150 transmits an analog signal converted by the ADC 160 through an antenna using a radio frequency, or receives an analog signal through the antenna and transfers the received analog signal to a portable computer through the ADC 160.

The ADC 160 is formed using analog baseband components. The ADC 160 may comprise a reception converter circuit 164 and a transmission converter circuit 162.

The reception converter circuit 164 down-converts an analog intermediate frequency (IF) signal received through the antenna element 120 to a baseband signal, and converts the analog baseband signal into a digital signal.

The transmission converter circuit 162 receives digital data from the CPU 180, converts the received data into an analog baseband signal, up-converts the analog baseband signal to an IF band, and transmits the up-converted signal through the RF transceiver 150.

The connector 170 is electrically connected to bus lines of a portable computer to transfer power supplied from the power supply unit 185 to the wireless communication unit 110. The connector 170 transfers digital signals converted by the ADC 160 to the CPU 180 through the bus lines. The connector 170 receives the digital signals from the CPU 180 through the bus line, and transfers the received signals to the transmission converter circuit 162 of the ADC 160.

The controller 145 is, for example, a microcomputer housed in the wireless communication unit 110. The controller 145 controls function blocks of the wireless communication unit 110, and displays the results received from the power calculation unit 140 on the display 190.

Figure 2A:
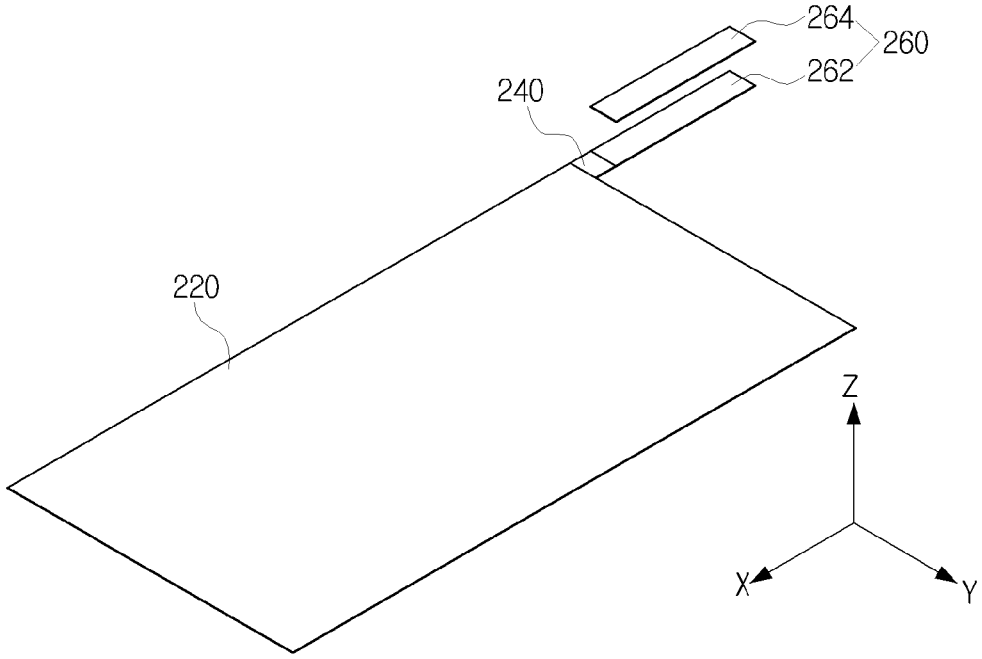
FIGS. 2A and 2B are diagrams illustrating antennas in a monopole mode and a dipole mode respectively according to exemplary embodiments.
Figure 2B:
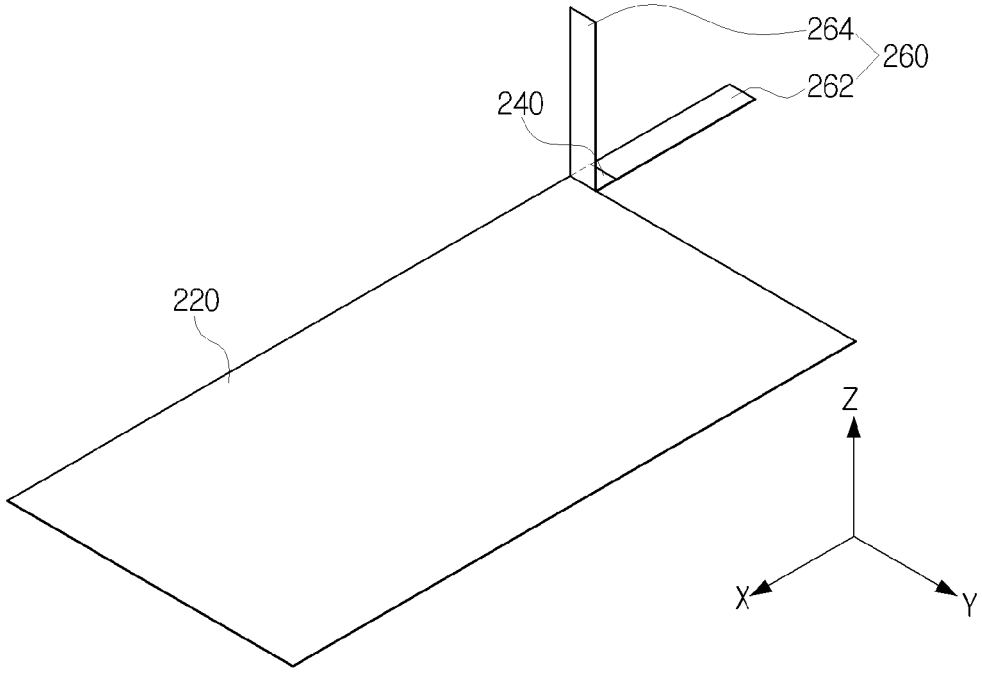

FIGS. 2A and 2B are diagrams illustrating antennas in a monopole mode and a dipole mode respectively according to an exemplary embodiment. The antenna may comprise a ground 220, a feeding unit 240, and an antenna element 260. The antenna element 260 consists of a radiation unit 262 and a parasitic element 264.

The ground 220 is formed on one side of a circuit board having the wireless communication unit 110 in a plate configuration. The feeding unit 240 is disposed at a corner of the ground 220, and feeds the radiation unit 262. The radiation unit 262 is connected to the feeding unit 240, and may be disposed on the X-axis of the same surface as the ground 220. Where an antenna is in a monopole mode, the parasitic element 264 may be disposed on the X-axis of the ground 220 as illustrated in FIG. 2A. In the monopole mode, the parasitic element 264 may be separated from the ground 220, feeding unit 240, and radiation unit 262 at a predetermined interval. The parasitic element 264 may be vertically parallel to the radiation unit 262, and an auxiliary object (not illustrated) may be inserted between the parasitic element 264 and the radiation unit 262 in order that the parasitic element 264 is separated from the radiation unit 262 at a predetermined interval.

Where an antenna is in a dipole mode as illustrated in FIG. 2B, the parasitic element 264 is connected to the ground 220, and may be disposed on the Z-axis of the ground 220. Where the feeding unit 240 applies current to the radiation unit 262, a current with reverse charge flows back from the electrode of the radiation unit 262 into the parasitic element 264, so the parasitic element 264 operates as an antenna element. The current is applied to the parasitic element 264, so the length of the antenna element corresponds to the sum $\lambda/2$ of the radiation unit 252 and the parasitic element 264 (wherein, $\lambda$=the wavelength of electromagnetic waves). As the radiation unit 262 and the parasitic element 264 operate as antenna elements, an antenna according to an exemplary embodiment is referred to as a dipole antenna.

Figure 3A:
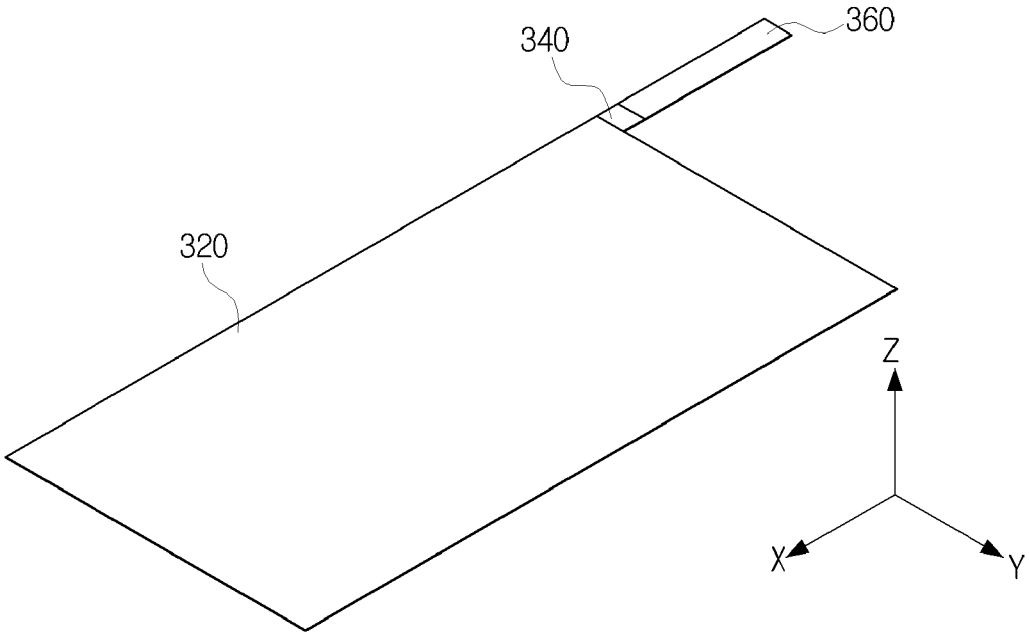
FIG. 3A is a diagrams illustrating an exemplary monopole antenna without a parasitic element.
Figure 3B:
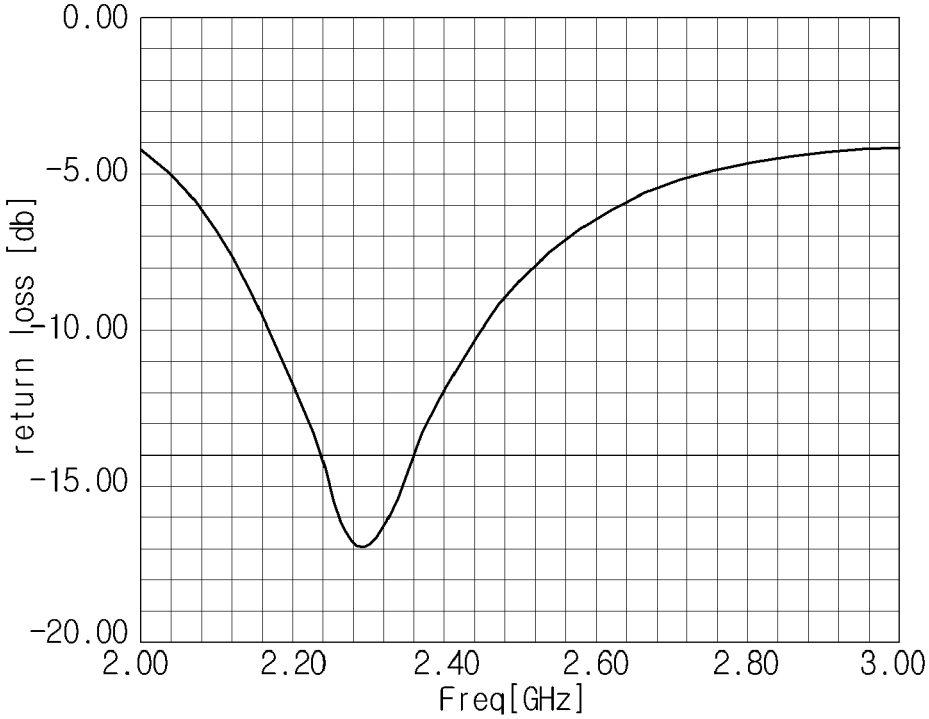
FIG. 3B is a graph illustrating return loss for an exemplary monopole antenna without a parasitic element.

FIG. 3A is a diagram illustrating an exemplary monopole antenna without a parasitic element, and FIG. 3B is a graph illustrating return loss in an exemplary monopole antenna without a parasitic element. Electromagnetic waves resonate at frequencies ranging from 2.2 GHz to 2.4 GHz with respect to a return loss of the monopole antenna of −10 dB.

Figure 4A:
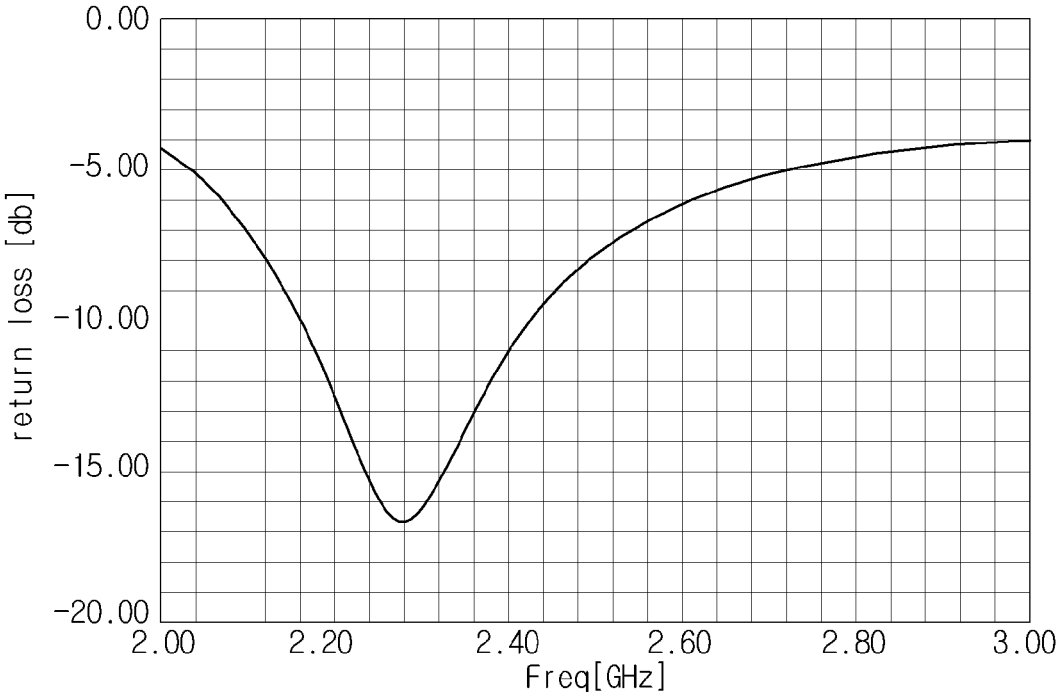
FIG. 4A is a graph illustrating return loss for an exemplary monopole antenna having a parasitic element.

FIG. 4A is a graph illustrating return loss in an exemplary monopole antenna having a parasitic element. The antenna of FIG. 4A is in a monopole mode, wherein a parasitic element is disposed as shown in FIG. 2A. Referring to FIG. 4A, electromagnetic waves resonate at frequencies ranging from 2.2 GHz to 2.4 GHz with respect to a return loss of the monopole antenna having a parasitic element of −10 dB. Where a parasitic element and a radiation unit are provided, the efficiency of an antenna does not deteriorate.

Figure 4B:
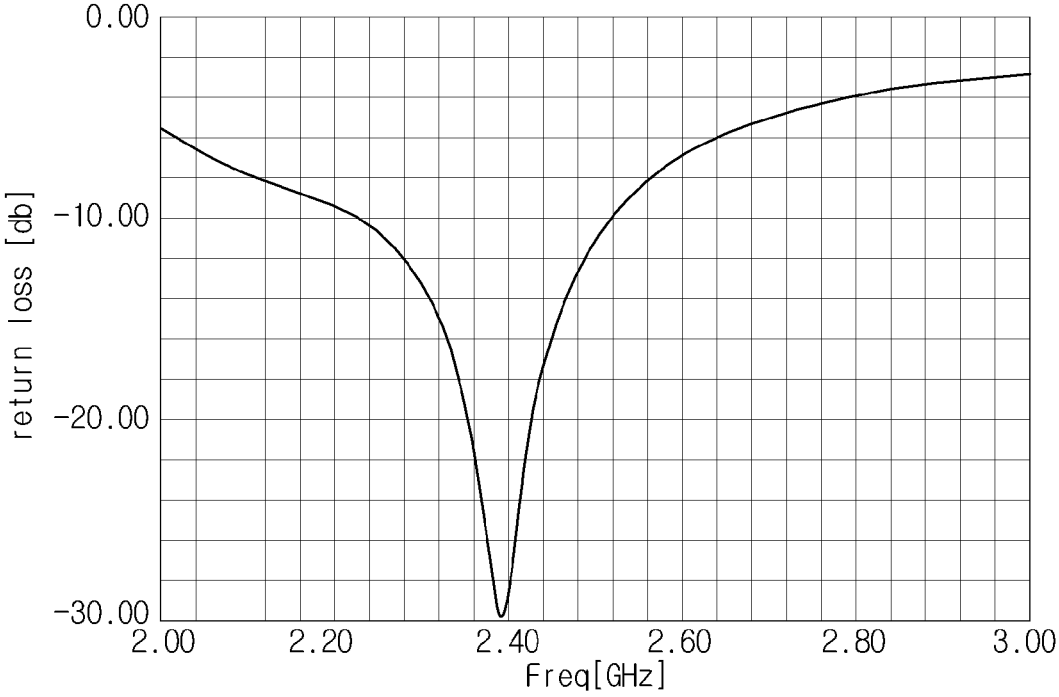
FIG. 4B is a graph illustrating return loss for an exemplary dipole antenna having a parasitic element.

FIG. 4B is a graph illustrating return loss in an exemplary dipole antenna having a parasitic element, wherein the parasitic element is connected to a radiation unit as shown in FIG. 2B. Referring to FIG. 4B, the electromagnetic waves resonate at frequencies ranging from 2.2 GHz to 2.4 GHz with respect to a return loss of the dipole antenna of −10 dB. The return loss of the dipole antenna is lower than that of the monopole antenna. Accordingly, the efficiency of the antenna is enhanced.

Where an antenna receives a large amount of power, the monopole antenna and dipole antenna achieve the same efficiency. However, where an antenna receives a small amount of power, the efficiency of the dipole antenna deteriorates less than that of a monopole antenna.

Figure 5A:
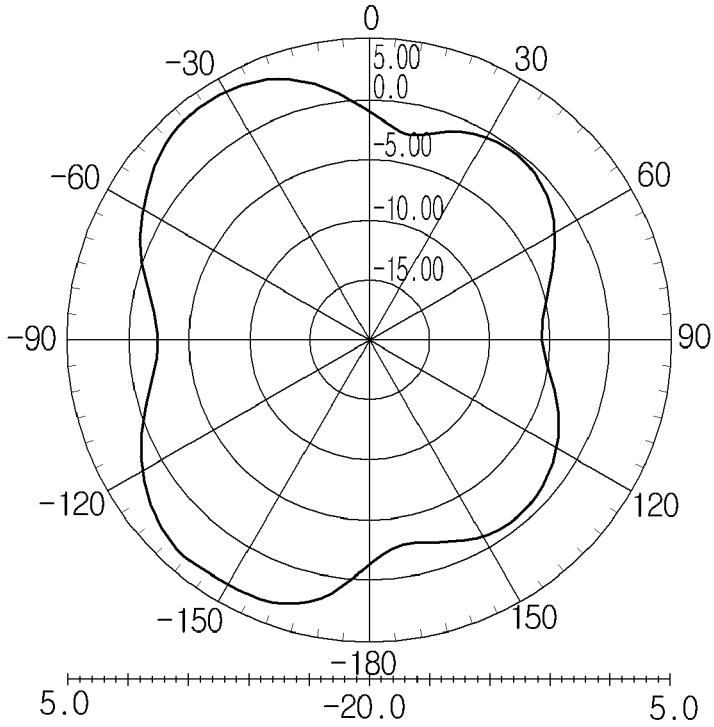
FIGS. 5A to 5C are graphs illustrating radiation patterns of an exemplary antenna in an electric field (E-field), that is, on an xz-plane.
Figure 5B:
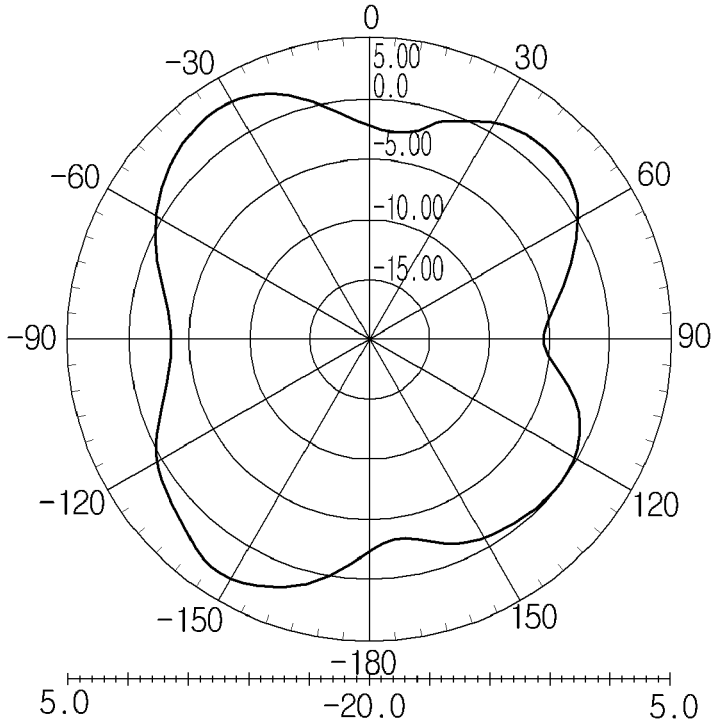
Figure 5C:
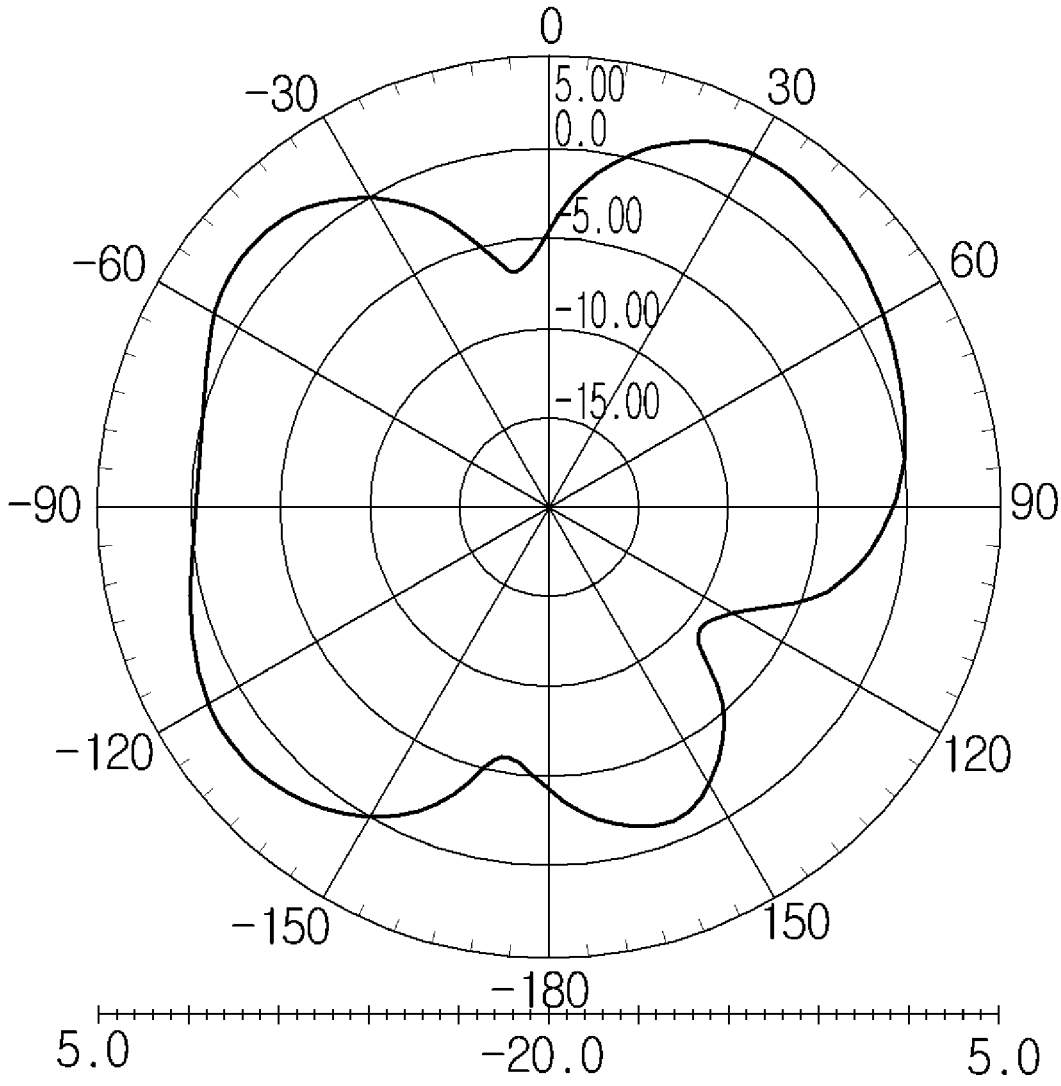

FIGS. 5A to 5C are graphs illustrating radiation patterns of exemplary antennas in an electrical field (E-field), that is, on an xz-plane. FIG. 5A is a graph illustrating a radiation pattern of an exemplary monopole antenna without a parasitic element in an E-field, and shows that the radiation pattern is directed toward a ground. The average gain of the antenna is thus lowered.

FIG. 5B is a graph illustrating a radiation pattern of an exemplary monopole antenna having a parasitic element in an E-field. The radiation pattern of the monopole antenna having a parasitic element is directed toward a ground in a similar manner to the radiation pattern of the monopole antenna without a parasitic element, so the antenna efficiency is reduced. Where the antenna receives a large amount of power, problems caused by irregular radiation patterns seldom occur, so an antenna receiving high power level may operate in a monopole mode.

FIG. 5C is a graph illustrating a radiation pattern of an exemplary dipole antenna having a parasitic element in an E-field. The beam of the dipole antenna is inclined towards one side of the dipole antenna. This prevents a part of the radiation pattern from being distributed toward the ground, and prevents a loss of efficiency of the antenna.

In an exemplary manner described above, the distribution of the radiated beams is controlled, and thus the efficiency of the antenna is improved.

Figure 6A:
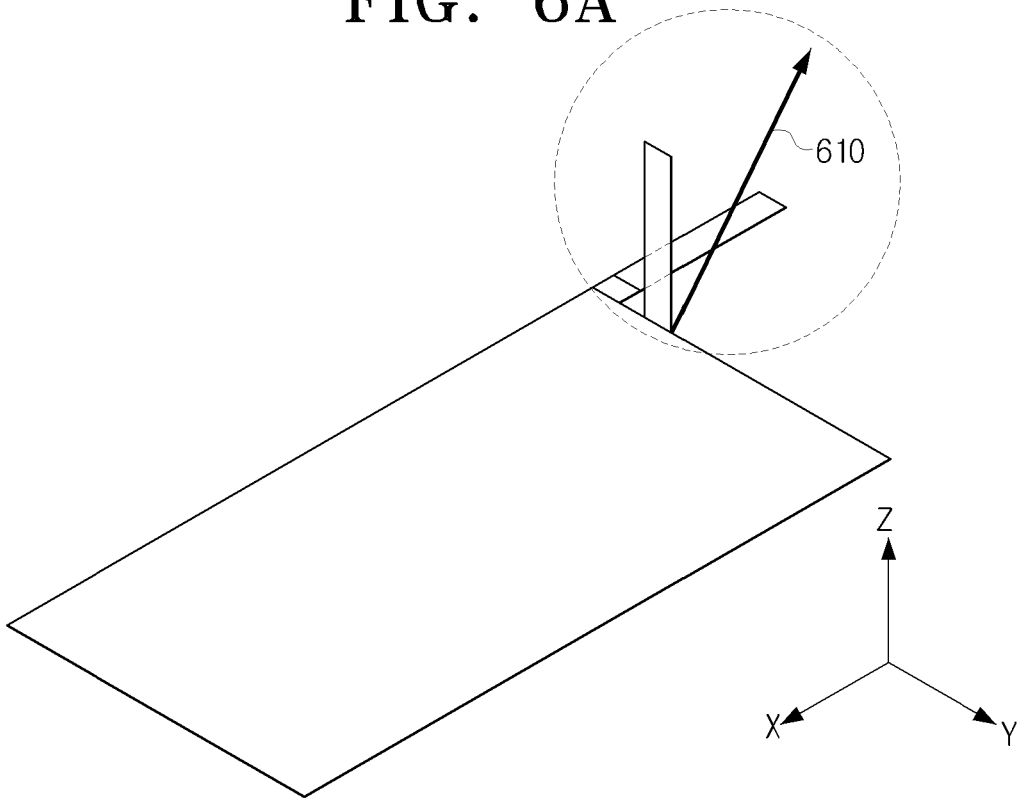
FIGS. 6A and 6B are views illustrating an antenna in a dipole mode according to another exemplary embodiment.
Figure 6B:
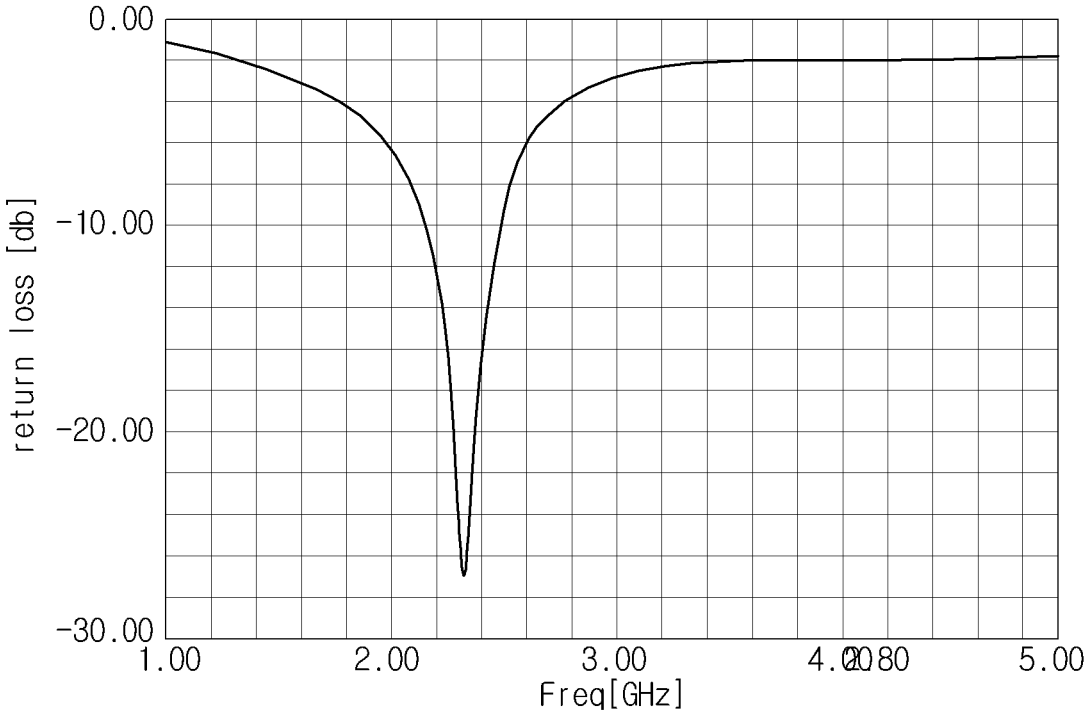

FIGS. 6A and 6B are diagrams illustrating an antenna in a dipole mode according to another exemplary embodiment. A parasitic element does not need to be parallel with a radiation unit, as illustrated in FIG. 6A. One side of the parasitic element is connected to a ground, and is arranged so that the vector sum 610 of the parasitic element and the radiation unit is opposite the vector of the ground. FIG. 6B is a graph illustrating return loss in the dipole antenna of FIG. 6A. Whether or not the parasitic element is parallel to the radiation unit, electromagnetic waves resonate in the same frequency range.

Figure 7A:
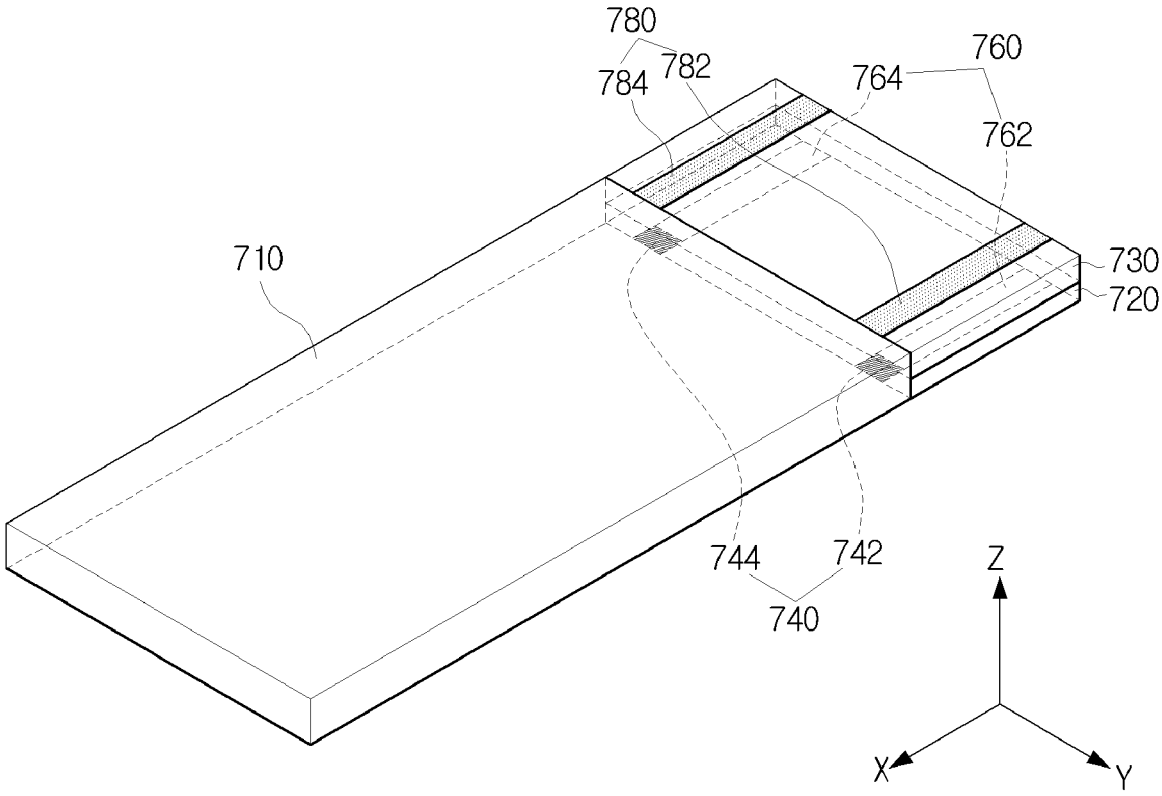
FIGS. 7A and 7B are perspective views illustrating a wireless communication unit applicable to an exemplary embodiment.
Figure 7B:
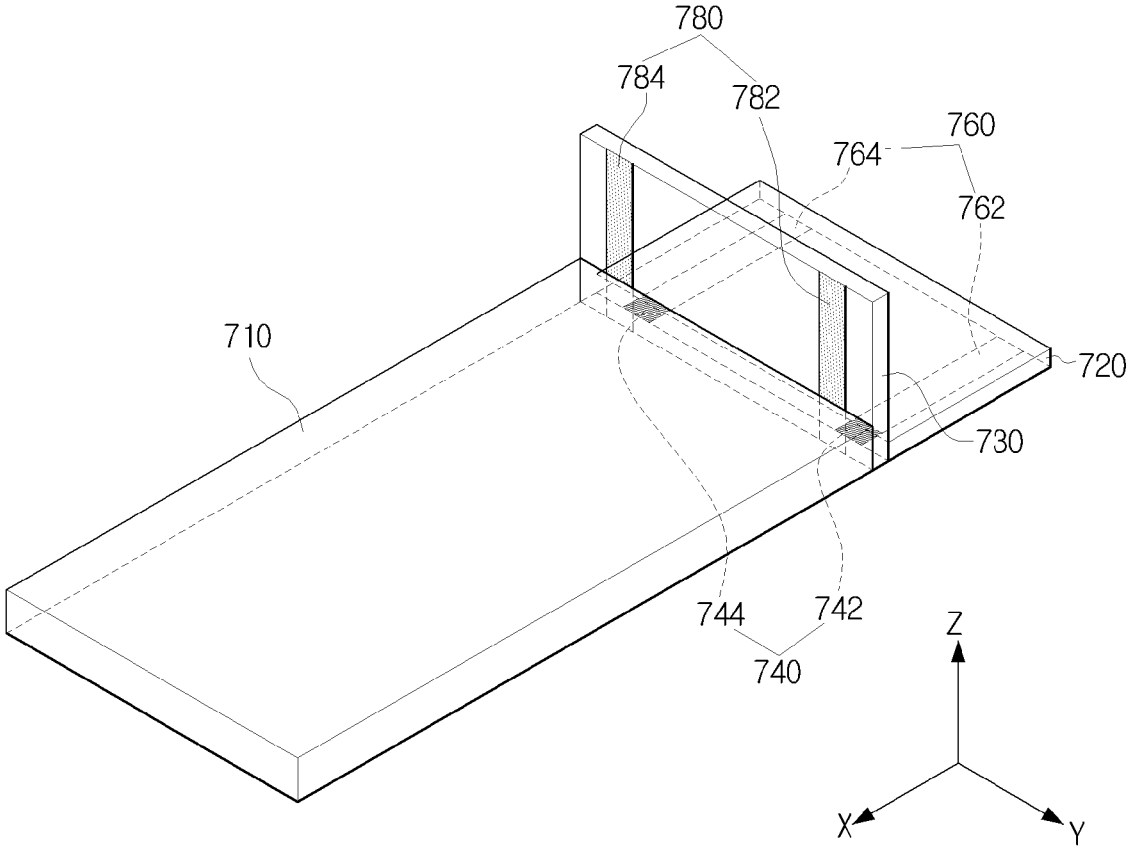

FIGS. 7A and 7B are perspective views illustrating a wireless communication unit applicable to an exemplary embodiment disclosed herein.

A wireless communication unit communicates using a multiple-input and multiple-output (MIMO) antenna. The wireless communication unit may comprise a first substrate 710 having function blocks such as an RF transceiver 150, a second substrate 720 having a radiation unit 760, and a third substrate 730 having a parasitic element 780. A ground (not illustrated) may be disposed on a bottom surface of the first substrate 710, the radiation unit 760 may be disposed on a bottom surface of the second substrate 720, and the parasitic element 780 may be disposed on an upper surface of the third substrate 730. A feeding unit 740 may be disposed on a bottom surface of the second substrate 720 between the ground and the radiation unit 760.

A user may use the wireless communication unit 110 in a monopole mode in an area where conditions are appropriate for receiving electromagnetic waves as illustrated in FIG. 7A. However, if reception is poor, a user may use the wireless communication unit 110 in a dipole mode as illustrated in FIG. 7B.

The third substrate 730 may be vertically inserted between the first substrate 710 and the second substrate 720 so that the parasitic element 780 contacts the ground, and is perpendicular to the radiation unit 760.

A user can convert antenna modes manually the display 190 according to the condition of the received electromagnetic waves. Alternatively, it is possible for the controller 140 of the wireless communication unit 110 to control the mode converter 130 to automatically convert modes according to the condition of the received electromagnetic waves.

Where a certain embodiment disclosed herein is applied to a multiple-input multiple-output (MIMO) antenna, radiation patterns may be controlled to improve pattern correlations among antennas.

While the radiation unit and parasitic element are formed in a strip line configuration, it is understood that this is only exemplary. The radiation unit and parasitic element may be formed in other configurations.

According to certain embodiments described above, an antenna may be converted to a monopole mode and a dipole mode. Thus, the antenna may operate adaptably according to the amount of power supplied.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An antenna having a parasitic element, comprising:

a ground;

a radiation unit; and a parasitic element selectively connected to the ground, and configured to operate as an antenna element, wherein if the antenna is in a first mode, electromagnetic waves resonate in the radiation unit, and if the antenna is in a second mode, electromagnetic waves resonate in the radiation unit and the parasitic element.

2. The antenna of claim 1, further comprising:

a feeding unit which feeds the radiation unit, wherein the feeding unit feeds the radiation unit in the first mode and the second mode, and the ground feeds the parasitic element in the second mode.

3. The antenna of claim 1, wherein if the antenna is in the first mode, the parasitic element is not connected to the ground, and if the antenna is in the second mode, the parasitic element is connected to the ground.

4. The antenna of claim 1, wherein a frequency band of the electromagnetic wave resonating in the first mode is the same as a frequency band of the electromagnetic wave resonating in the second mode.

5. The antenna of claim 1, wherein the radiation unit and the parasitic element are formed in a strip line configuration, and the radiation unit and the parasitic element of the second mode are inclined at a predetermined angle.

6. The antenna of claim 5, wherein the radiation unit of the second mode is perpendicular to the parasitic element.

7. The antenna of claim 5, wherein the radiation unit and the parasitic element of the second mode are arranged on the same surface.

8. The antenna of claim 1, wherein the radiation unit and the parasitic element are arranged parallel to each other.

9. The antenna of claim 1, wherein the radiation unit is disposed substantially co-planar to the ground.

10. A method for operating an antenna having a ground, a radiation unit, and a parasitic element selectively connected to the ground and configured to operate as an antenna element, the method comprising:

in response to the antenna being in a first mode, resonating electromagnetic waves in the radiation unit; and in response to the antenna being in a second mode, resonating electromagnetic waves in the radiation unit and the parasitic element by connecting the parasitic element to ground.

* * * * *